US011843212B2

(12) United States Patent
Jaeger

(10) Patent No.: US 11,843,212 B2
(45) Date of Patent: Dec. 12, 2023

(54) INSULATION DISPLACEMENT CONTACT FOR CONTACTING AN INSULATED RIBBON CABLE

(71) Applicant: TE Connectivity Nederland BV, 's-Hertogenbosch (NL)

(72) Inventor: Peter Dirk Jaeger, 's-Hertogenbosch (NL)

(73) Assignee: TE Connectivity Nederland BV, S-Hertogenbosch (NL)

( * ) Notice: Subject to any disclaimer, the term of this patent is extended or adjusted under 35 U.S.C. 154(b) by 0 days.

(21) Appl. No.: 17/510,841

(22) Filed: Oct. 26, 2021

(65) Prior Publication Data

US 2022/0131283 A1 Apr. 28, 2022

(30) Foreign Application Priority Data

Oct. 28, 2020 (EP) ..... 20204434

(51) Int. Cl.
*H01R 4/2441* (2018.01)

(52) U.S. Cl.
CPC ..... *H01R 4/2441* (2013.01)

(58) Field of Classification Search
CPC .. H01R 12/675; H01R 4/2441; H01R 4/2458; H01R 4/242; H01R 9/03; H01R 9/11
See application file for complete search history.

(56) References Cited

U.S. PATENT DOCUMENTS

| | | | | |
|---|---|---|---|---|
| 3,964,816 | A | 6/1976 | Narozny | |
| 4,009,921 | A | 3/1977 | Narozny | |
| 4,043,628 | A | 8/1977 | Narozny | |
| 2004/0192103 | A1* | 9/2004 | Lee | H01R 12/675 439/404 |
| 2007/0099476 | A1 | 5/2007 | Othmar | |
| 2008/0305661 | A1* | 12/2008 | Neumetzler | H01R 9/2441 439/92 |
| 2020/0036109 | A1 | 1/2020 | Txarola | |

FOREIGN PATENT DOCUMENTS

| | | | |
|---|---|---|---|
| DE | 2708175 | A1 | 9/1977 |
| EP | 0011923 | A1 | 6/1980 |
| EP | 0259211 | A1 | 8/1987 |
| EP | 1225656 | A * | 7/2002 |
| JP | 5145787 | A | 4/1976 |
| JP | 52155387 | A | 12/1977 |
| JP | 5415294 | U | 1/1979 |
| JP | H08264209 | A | 10/1996 |

OTHER PUBLICATIONS

Office Action from the Japanese Patent Office dated Dec. 6, 2022, corresponding to Application No. 2021-173565 with English translation, 11 pages.
Extended European Search Report, Application No. 20204434.3-1201, dated Mar. 19, 2021, 12 pages.

* cited by examiner

*Primary Examiner* — Jean F Duverne
(74) *Attorney, Agent, or Firm* — Barley Snyder

(57) ABSTRACT

An insulation displacement contact has a tubular body extending along a longitudinal axis toward an open end. The tubular body has a pair of cutting edges at the open end. The tubular body has a pair of opposing side surfaces each having a slot extending to the open end and disposed between the cutting edges. The slot on one of the opposing side surfaces is a contacting slot and the slot on the other of the opposing side surfaces is a positioning slot. A first clear width of the contacting slot is less than a second clear width of the positioning slot.

18 Claims, 3 Drawing Sheets

INSULATION DISPLACEMENT CONTACT FOR CONTACTING AN INSULATED RIBBON CABLE

CROSS-REFERENCE TO RELATED APPLICATIONS

This application claims the benefit of the filing date under 35 U.S.C. § 119(a)-(d) of European Patent Application No. 20204434.3, filed on Oct. 28, 2020.

FIELD OF THE INVENTION

The present invention relates to an insulation displacement contact and, more particularly, to an insulation displacement contact for contacting a conductor of an insulated ribbon cable.

BACKGROUND

Insulated ribbon cables typically comprise a plurality of conductor lines running parallel to one another. The conductor lines are spaced apart from one another in order to prevent short circuiting between the conductor lines. In order to contact a single conductor line, insulation displacement contacts are used, which comprise cutting edges to pierce through the insulation and receive the conductor line within a contacting slot. The insulation displacement contact has to be configured to provide a sufficient normal force for reliably contacting the conductor line. For this, insulation displacement contacts known in the state of the art have large widths perpendicular to the conductor line.

However, the trend in insulated ribbon cables moves towards miniaturization such that, for example, due to signal integrity requirements, modern conductor lines having a relatively large diameter are arranged adjacent to one another at a low pitch, i.e. close to one another. However, current insulation displacement contacts are not capable of contacting one conductor line with sufficient normal force while being safely spaced apart from the adjacent conductor line for preventing a short circuit.

SUMMARY

An insulation displacement contact has a tubular body extending along a longitudinal axis toward an open end. The tubular body has a pair of cutting edges at the open end. The tubular body has a pair of opposing side surfaces each having a slot extending to the open end and disposed between the cutting edges. The slot on one of the opposing side surfaces is a contacting slot and the slot on the other of the opposing side surfaces is a positioning slot. A first clear width of the contacting slot is less than a second clear width of the positioning slot.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
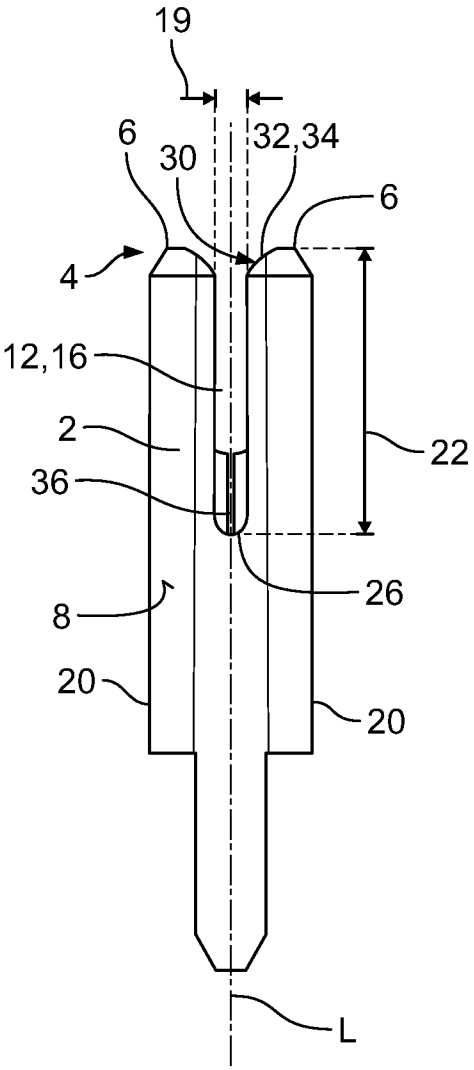
FIG. 2 is a side view of the insulation displacement contact of FIG. 1.

In the following, exemplary embodiments of the invention are described with reference to the drawings. The shown and described embodiments serve explanatory purposes only. The combination of features shown in the embodiments may be changed according to the description. For example, a feature which is not shown in an embodiment but described herein may be added if the technical effect associated with this feature is beneficial for a particular application, and vice versa (a feature shown as part of an embodiment may be omitted if the technical effect associated with this feature is not needed in a particular application). In the drawings, elements that correspond to each other with respect to function and/or structure have been provided with the same reference numeral.

Figure 3:
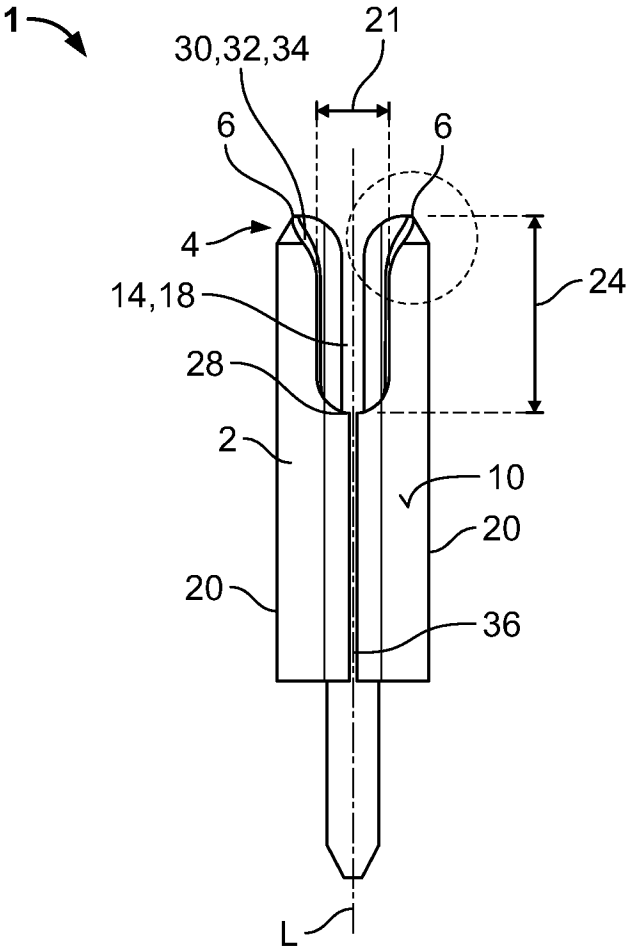
FIG. 3 is another side view of the insulation displacement contact of FIG. 1.

An insulation displacement contact 1 according to an embodiment is shown in FIGS. 1-4. The insulation displacement contact 1 comprises a tubular body 2, the tubular body 2 extending along a longitudinal axis L towards an open end 4. The open end 4 has at least two separate cutting edges 6, wherein on opposing side surfaces 8, 10 of the tubular body 2, slots 12, 14 are formed. The slot 12 at one of the opposing side surfaces 8 is formed as a contacting slot 16 and the slot 14 at the other of the opposing side surfaces 10 is formed as a positioning slot 18. In the shown embodiment, a first clear width 19 of the contacting slot 16 is smaller than a second clear width 21 of the positioning slot 18, as shown in FIGS. 2 and 3. The clear width 19, 21 of the slots 16, 18 may extend essentially parallel to the respective side surface and essentially perpendicular to the longitudinal axis L of the tubular body 2.

The open end 4 of the tubular body 2 may be planar in a cross section perpendicular to the longitudinal axis L. In this case, the cutting edges 6 are arranged at the same level along the longitudinal axis L and therefore simultaneously cut through the insulation of the insulated ribbon cable. Consequently, an even force distribution of the cutting force on the insulation is achieved.

The contacting slot 16 and the positioning slot 18 may be opened towards the open end 4, so that a conductor line may be easily be inserted along the longitudinal axis L of the insulation displacement contact 1 in the corresponding slots 16, 18. By providing a curvature in the tubular body 2, the normal force for contacting the conductor line in the contacting slot 16 may be increased, while simultaneously reducing the total width of the insulation displacement contact 1. As the positioning slot 18 comprises a greater clear width 21 than the contacting slot 16, it may be ensured that sufficient normal force is provided at the contacting slot 16 and not evenly distributed onto two contacting slots having the same clear width. Further, it is ensured that only the contact slot 16 contacts the conductor line.

Figure 1:
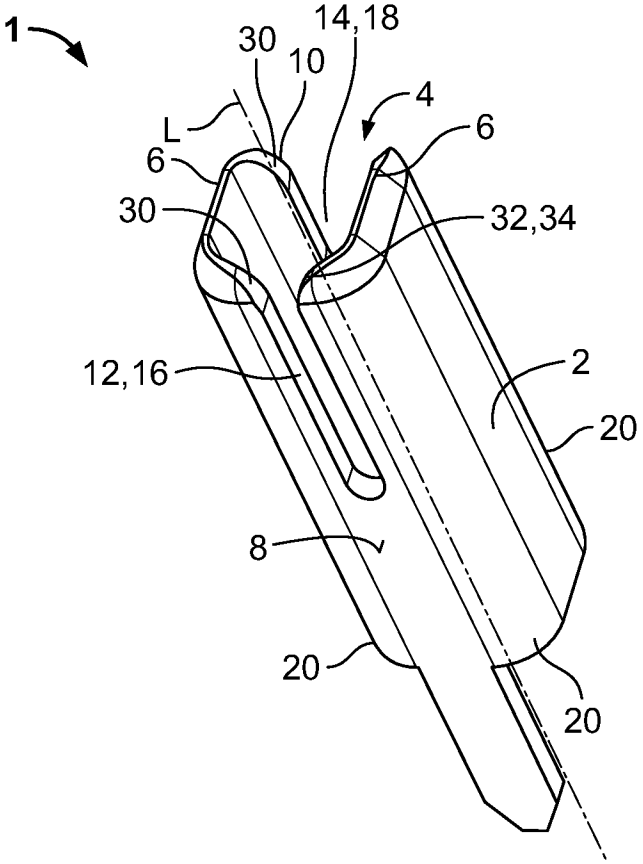
FIG. 1 is a perspective view of an insulation displacement contact according to an embodiment.

It is to be noted that the term "tubular" is not to be construed as being restricted to a circular cross section essentially perpendicular to the longitudinal axis L. The body 2 may alternatively have a polygonal cross section essentially perpendicular to the longitudinal axis L, for example. The clear width 19, 21 of the slots 16, 18 may extend essentially parallel to the respective side surface and essentially perpendicular to the longitudinal axis L of the tubular body 2. As shown in the embodiment of FIG. 1, the tubular shaped body 2 has a quadrilateral cross section, more specifically rectangular or even square cross section, in a plane essentially perpendicular to the longitudinal axis L. Consequently, the tubular shaped body 2 has four curved edges 20, each of the edges 20 further increasing the rigidity of the insulation displacement contact 1 and therefore increasing the normal force.

FIGS. 2 and 3 each show a side view of the insulation displacement contact 1, wherein FIG. 2 shows a view facing the side surface 8 with the contacting slot 16 and FIG. 3 shows a side view facing the side surface 10 with the positioning slot 18.

As shown in FIGS. 2 and 3, the contacting slot 16 has a first depth 22 essentially parallel to the longitudinal axis L and the positioning slot 18 has a second depth 24 essentially parallel to the longitudinal axis L. The first depth 22 may be greater than the second depth 24 starting from the same level along the longitudinal axis L. Thus, the contacting slot 16 may have a first end 26 being further distanced from the open end 4 than a second end 28 of the positioning slot 18. The first end 26 and the second end 28 are offset from one another along the longitudinal axis L.

The second end 28 may serve as support for the conductor line, when the conductor line is contacted in the contacting slot 16. During the contacting process, the conductor line usually is not pushed to the first end 26 of the contacting slot 16. Rather, it is held at a middle section between open end 4 and first end 26. Thus, the second end 28 may be positioned so that it is configured to serve as a seat for the conductor line, when the conductor line is contacted.

In order to have the conductor line pass through the insulation displacement contact 1 in a straight line, the contacting slot 16 and the positioning slot 18 may be aligned with one another. In an embodiment, a center line of the contacting slot 16 and a center line of the positioning slot 18 essentially perpendicular to the longitudinal axis L may be aligned. Hence, no bending strain is exerted on the conductor line between the positioning slot 18 and the contacting slot 16.

As shown in FIGS. 2 and 3, the slots 12, 14 may widen towards the cutting edges 6 forming an entry guide 30 for guiding the conductor line towards the respective slot 12, 14, more specifically towards the center lines of the respective slot 12, 14. In this embodiment, the slots 12, 14 are arranged at the center of the respective side surface 8, 10 and the slots 12, 14 may widen symmetrically to the cutting edges 6. A transition zone 32 between slot and cutting edge 6 may be provided, for example in the form of a rounded corner 34. This may be advantageous, as damage to the conductor line due to sharp corners may be prevented.

In one embodiment, the slots 12, 14 may widen asymmetrically towards the separate cutting edges 6, wherein at least towards the cutting edge 6 being arranged proximal to the adjacent conductor line, the slope may be configured to gently guide the conductor line towards the respective slot 12, 14. A chamfer may extend from the respective slot 12, 14 to the cutting edge 6, the chamfer having a slope along which the conductor line may glide and is directed towards the respective slot.

When contacting the corresponding conductor line, a high mechanical stress is subjected to the insulation displacement contact 1, which may cause large permanent plastic deformation and failure of the insulation displacement contact 1, especially in view of a long-term application. The tubular body 2 may have a slit 36 extending essentially parallel to the longitudinal axis L splitting the tubular body 2 circumferentially, as shown in FIGS. 2 and 3.

In the exemplary embodiment shown in FIGS. 2 and 3, the slit 36 and the positioning slot 18 are arranged on the same side surface 10, therefore a widening of the positioning slot 18 is made possible by slit 36 without putting too much strain on the insulation displacement contact 1. The slit 36 and the positioning slot 18 are aligned with one another along the longitudinal axis L, wherein the slit 36 opens into the positioning slot 18 opposite the open end 4. Hence, the provision of the slit 36 has a very low impact on the normal force with which the conductor line may be contacted. Arranging the slit 36 at the same side surface as the contacting slot 36, however, would greatly reduce the contacting normal force, so that there is a risk that the conductor line would not be sufficiently contacted.

In an embodiment, the insulation displacement contact 1 may be formed as a stamped and bent part. In particular, the provision of a slit 36 allows a particularly easy manufacture of the insulation displacement contact 1 as arduous and expensive joining of two opposing ends along the circumferential direction may be prevented. The insulation displacement contact 1 may be formed from a blank, wherein the contacting slot 16 may be arranged at a base and the side surface 10 comprising the positioning slot 18 and slit 36 may be formed out of two flanks extending from opposing sides of the base, and being bent in such a way that the tubular body is formed and the free ends of the flanks face each other, each free end forming a half of the positioning slot 18 and the slit 36.

Figure 4:
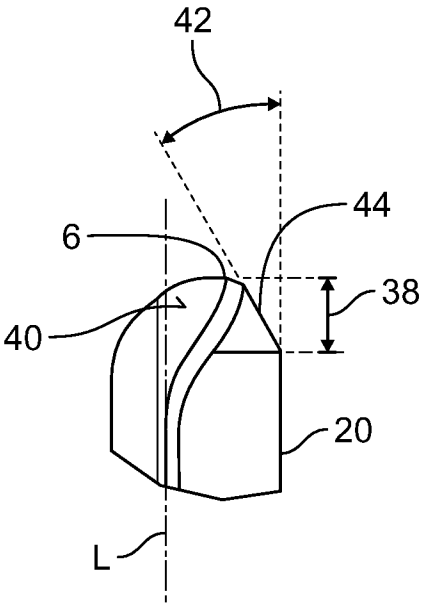
FIG. 4 is an enlarged view of a cutting blade of the insulation displacement contact of FIG. 1.

With reference to FIG. 4, the structure of the cutting edge 6 is described in more detail.

FIG. 4 shows an enlarged view of the section encircled in FIG. 3. The cutting edge 6 may be asymmetric, wherein the at least one cutting edge 6 tapers along the longitudinal axis L radially inwards. In this embodiment, the insulation which is penetrated by the cutting edge 6 is not pushed into the tubular body 2, as would be the case with a double sided cutting blade. Rather, it is pressed outwards towards the adjacent conductor line. Consequently, a bulk of insulation may be arranged between the insulation displacement contact 1 and the adjacent conductor line, which may further prevent the insulation displacement contact 1 from contacting the adjacent conductor line and potentially cause a short circuit.

The cutting edge 6 may have a single bevel 38, as shown in FIG. 4, wherein an inner surface 40 of the tubular body 2 may extend continuously in a straight line essentially parallel to the longitudinal axis L to the cutting edge 6. In an embodiment, the cutting edge 6 has a bevel angle 42 of about 30°, so that the cutting edge 6 is, on one hand, sharp enough to cut through the insulation without the necessity of excessive force and, on the other hand, forms a guiding slope 44 for guiding the insulation essentially radially outwards between the insulation displacement contact 1 and the adjacent conductor line.

In the embodiment of FIGS. 1-4, a symmetric insulation displacement contact 1 is shown, wherein each cutting edge 6 comprises the single bevel 38 and the slots 12, 14 are centrally arranged on the respective side surfaces. However, an asymmetric insulation displacement contact 1, wherein the slots 12, 14 are further distanced from one cutting edge 6 than the other, may also be provided. In that embodiment, the conductor line may be further displaced laterally without increasing the size of the insulation displacement contact 1.

One cutting edge 6 may be arranged proximal to the adjacent conductor line and the other cutting edge 6 may be arranged distal to the adjacent conductor line in a direction essentially perpendicular to the longitudinal axis L of the conductor lines. In order to further reduce the chances of a short circuit, at least the cutting edge proximal to the adjacent conductor line may be asymmetric.

Figure 6:
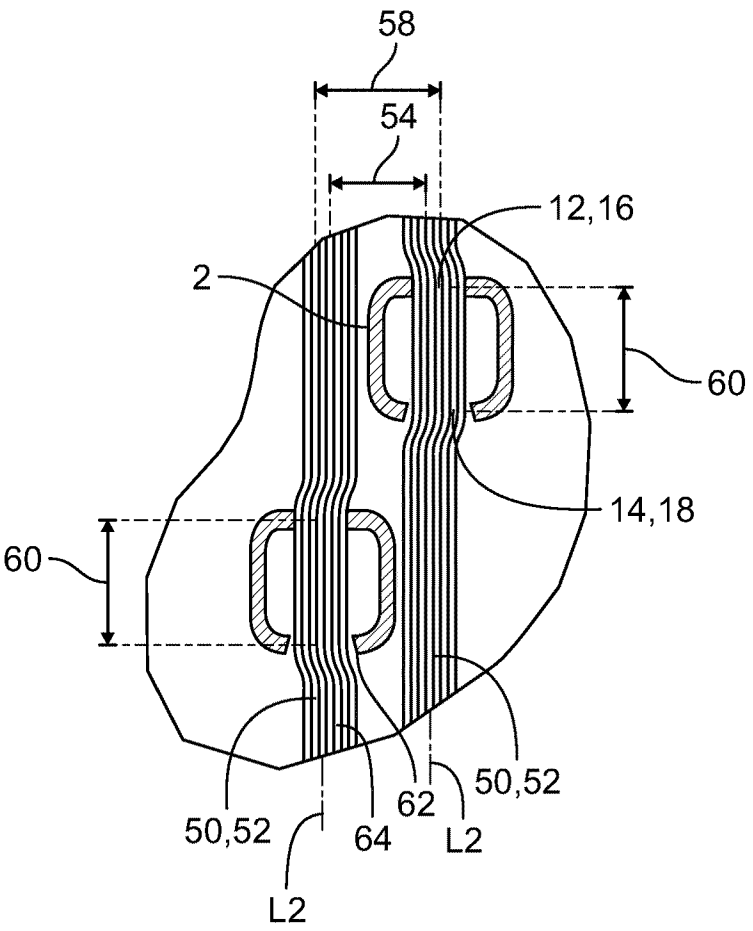
FIG. 6 is a schematic top view of a portion of the connector assembly of FIG. 5.
Figure 5:
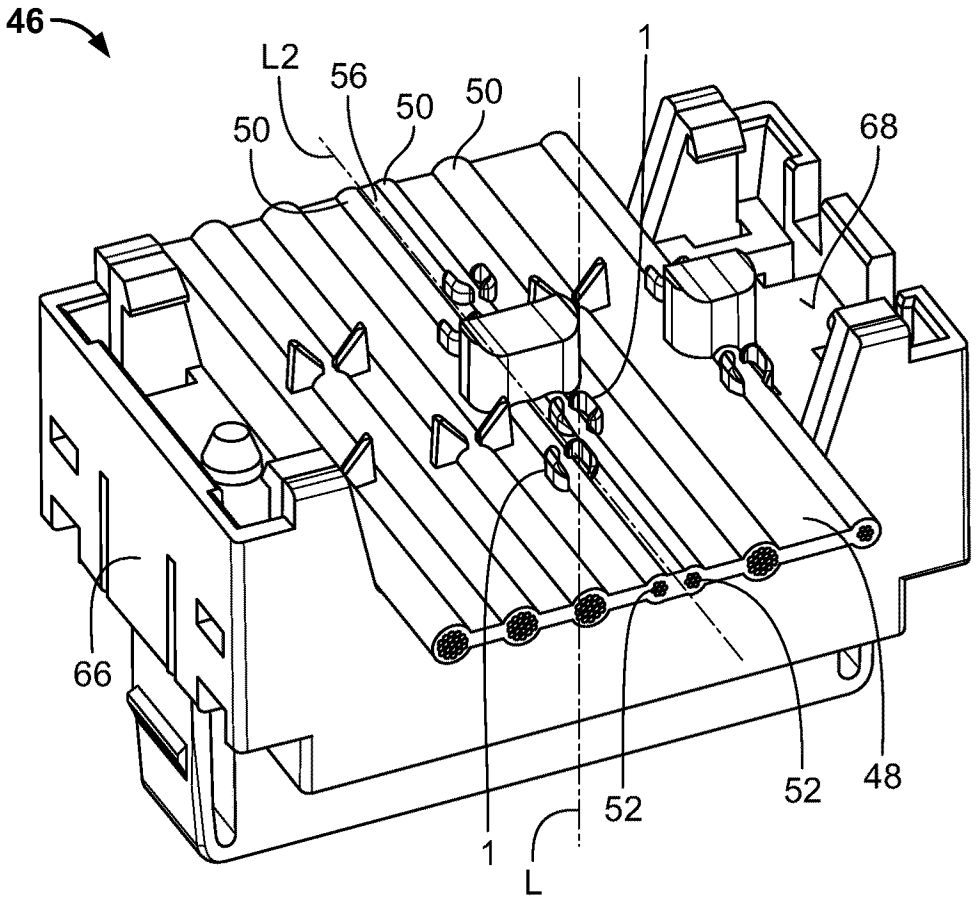
FIG. 5 is a perspective view of a connector assembly according to an embodiment.

Hereinafter, an exemplary embodiment of a connector assembly 46 is further elucidated with respect to FIGS. 5 and 6. In FIG. 5, the connector assembly 46 is shown in a schematic perspective view and in FIG. 6, the connector assembly 46 is shown in a simplified schematic top view.

The connector assembly 46 has an insulated ribbon cable 48 having a plurality of conductor lines 50. At least two adjacent conductor lines 52 are spaced apart relative from one another at a predetermined pitch 54, as shown in FIG. 6. The insulated ribbon cable 48 may extend along a longitudinal axis L2, wherein the plurality of conductor lines 50 may be arranged parallel to one another and separated from one another by the insulation 56 preventing a direct contact between the conductor lines 52. The at least two adjacent conductor lines 52 are defined as the conductor lines having the smallest pitch out of each pair of the plurality of conductor lines 50. The predetermined pitch 54 may, for example, be about 1.2 mm and the conductor lines 50, which may be composed of a plurality of conductor strands, may have a relatively large conductor size, such as an American Wire Gauge (AWG) 24 conductor. For these dimensions in particular, there is a struggle to provide an insulation displacement contact that allows the conductor line 50 to be contacted without abutting the adjacent conductor line and potentially causing a short circuit.

The connector assembly 46 has at least two insulation displacement contacts 1 according to the above embodiment for contacting the at least two adjacent conductor lines 52, wherein the at least two insulation displacement contacts 1 are laterally spaced apart from one another at a larger pitch 58 than the predetermined pitch 54. The pitch 58 being defined as the distance in a direction essentially perpendicular to the longitudinal axis L of the insulation displacement contact 1 and the longitudinal axis L2 of the insulated ribbon cable 48. Alternatively or additionally, at least one insulation displacement contact 1 may be laterally offset from the corresponding conductor line 52.

In an embodiment, a center line of the insulation displacement contact 1, the slots 12, 14, essentially perpendicular to the longitudinal axis L of the tubular body 2 and essentially parallel to the longitudinal axis L2 of the conductor line, may be laterally offset from a center line of the conductor line. The slots 12, 14 may be arranged off-center on the corresponding side surface 8, 10, meaning that the center line of the contacting slot 16 may be laterally offset from a center line of the side surface 8, 10 essentially parallel to the longitudinal axis L of the tubular body 2, which features the contacting slot 16, and the center line of the positioning slot 18 may be laterally offset from a center line of the side surface 8, 20 essentially parallel to the longitudinal axis L of the tubular body 2 carrying the positioning slot 18. In an embodiment, the slots 12, 14 may be further distanced from one cutting edge 6 than from the other, more specifically, the slots 12, 14 may be arranged closer to the to the distal cutting edge 6 than to the proximal cutting edge 6.

The corresponding conductor line 52 will be laterally displaced when being contacted by the insulation displacement contact 1 in order to enter the positioning slot 18 and the contacting slot 16. Therefore, the distance of the conductor line 52 to the adjacent conductor line 52 is increased at least in a section 60 shown in FIG. 6 at which the conductor line 52 is held by the insulation displacement contact 1. This may be particularly advantageous, as the larger space between the conductor lines 52 further reduces the risk of the insulation displacement contact 1 touching the adjacent conductor line 52. The insulation displacement contact 1 according to the invention is a miniaturized insulation displacement contact, which allows for a reliable and safe contacting of the conductor line 52 of the insulated ribbon cable 48.

To further reduce the risk of a short circuit, the at least two insulation displacement contacts 1 may be offset from one another in a direction essentially parallel to the longitudinal axis L2 of the conductor lines 50. Consequently, the at least two insulation displacement contacts 1 are not arranged in a single plane essentially perpendicular to the longitudinal axis L2 of the conductor lines 50 allowing for contacting conductor lines 52 arranged relative to one another at even a smaller predetermined pitch.

In an embodiment, before contacting the corresponding conductor line 52, a side edge 62 of the positioning slot, for example the entry guide 30, may be aligned with a side edge 64 of the conductor line 52 facing the adjacent conductor line 52. Hence, during contacting it may be assured that the conductor line 52 glides along the entry guide 30 into the slot 14 and the contacting section 60 of the conductor line 52 is laterally displaced away from the adjacent conductor line 52.

The at least two insulation displacement contacts 1 may be part of an electrical connector 66, shown in FIG. 5, comprising a contact assembly 68 to which the at least two insulation displacement contacts 1 are mounted. At least one insulation displacement contact 1 is laterally offset from a center line of the corresponding conductor line 52 and/or the pitch 58 between the at least two insulation displacement contacts 1 may be larger than the predetermined pitch 54.

What is claimed is:

1. An insulation displacement contact, comprising:

a tubular body extending along a longitudinal axis toward an open end, the tubular body having a pair of cutting edges at the open end, the tubular body having a pair of opposing side surfaces each having a slot extending to the open end and disposed between the cutting edges, the slot on one of the opposing side surfaces is a contacting slot and the slot on the other of the opposing side surfaces is a positioning slot, a first clear width of the contacting slot is less than a second clear width of the positioning slot.

2. The insulation displacement contact of claim 1, wherein the contacting slot has a first end opposite the open end and the positioning slot has a second end opposite the open end, the first end and the second end are offset from one another along the longitudinal axis.

3. The insulation displacement contact of claim 2, wherein the first end is spaced further from the open end than the second end.

4. The insulation displacement contact of claim 1, wherein the contacting slot and the positioning slot are aligned with one another.

5. The insulation displacement contact of claim 1, wherein at least one of the cutting edges is asymmetric.

6. The insulation displacement contact of claim 1, wherein at least one of the cutting edges tapers along the longitudinal axis radially inwards.

7. The insulation displacement contact of claim 1, wherein the contacting slot and positioning slot widen toward the cutting edges.

8. The insulation displacement contact of claim 1, wherein the contacting slot and the positioning slot are arranged off-center on the side surfaces.

9. The insulation displacement contact of claim 1, wherein the tubular body has a slit extending along the longitudinal axis.

10. The insulation displacement contact of claim 9, wherein the slit and the positioning slot are aligned with one another along the longitudinal axis.

11. The insulation displacement contact of claim 9, wherein the slit opens into the positioning slot opposite the open end.

12. A connector assembly, comprising:

an insulated ribbon cable having a plurality of conductor lines extending parallel to one another along a longitudinal axis, at least two adjacent conductor lines of the plurality of conductor lines are laterally spaced apart from one another at a predetermined pitch; and a pair of insulation displacement contacts laterally spaced apart from one another at a pitch greater than the predetermined pitch, each of the insulation displacement contacts having a tubular body extending along a longitudinal axis toward an open end, the tubular body having a pair of cutting edges at the open end, the tubular body having a pair of opposing side surfaces each having a slot extending to the open end and disposed between the cutting edges, the slot on one of the opposing side surfaces is a contacting slot and the slot on the other of the opposing side surfaces is a positioning slot, a first clear width of the contacting slot is less than a second clear width of the positioning slot.

13. The connector assembly of claim 12, wherein the slots of one of the insulation displacement contacts and one of the conductor lines contacted by the one of the insulation displacement contacts are laterally offset from one another.

14. The connector assembly of claim 12, wherein the insulation displacement contacts are offset along the longitudinal axis of the insulated ribbon cable.

15. The connector assembly of claim 12, wherein a side edge of the positioning slot of one of the insulation displacement contacts is aligned with a side edge of one of the conductor lines contacted by the one of the insulation displacement contacts, the side edge of the one of the conductor lines faces an adjacent conductor line.

16. An electrical connector, comprising:

a contact assembly; and a pair of insulation displacement contacts mounted to the contact assembly, each of the insulation displacement contacts having a tubular body extending along a longitudinal axis toward an open end, the tubular body having a pair of cutting edges at the open end, the tubular body having a pair of opposing side surfaces each having a slot extending to the open end and disposed between the cutting edges, the slot on one of the opposing side surfaces is a contacting slot and the slot on the other of the opposing side surfaces is a positioning slot, a first clear width of the contacting slot is less than a second clear width of the positioning slot.

17. The electrical connector of claim 16, wherein the insulation displacement contacts contact an insulated ribbon cable having a plurality of conductor lines extending parallel to one another along the longitudinal axis, at least two adjacent conductor lines of the plurality of conductor lines are laterally spaced apart from one another at a predetermined pitch.

18. The electrical connector of claim 17, wherein the insulation displacement contacts are laterally spaced apart from one another at a pitch greater than the predetermined pitch.

* * * * *